US007666322B2

(12) United States Patent
Sugahara et al.

(10) Patent No.: US 7,666,322 B2
(45) Date of Patent: Feb. 23, 2010

(54) METHOD OF PRODUCING NOZZLE PLATE AND METHOD OF PRODUCING LIQUID-DROPLET JETTING APPARATUS

(75) Inventors: Hiroto Sugahara, Aichi-ken (JP); Hikoharu Aoki, Nagoya (JP); Kentaro Obara, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 265 days.

(21) Appl. No.: 11/536,713

(22) Filed: Sep. 29, 2006

(65) Prior Publication Data

US 2007/0076054 A1 Apr. 5, 2007

(30) Foreign Application Priority Data

Sep. 30, 2005 (JP) ..... 2005-286087

(51) Int. Cl.
*G11B 5/127* (2006.01)

(52) U.S. Cl. ..... 216/27; 29/729; 29/121.7; 29/121.71; 347/29; 347/47; 347/84; 430/5

(58) Field of Classification Search ..... 216/27; 29/729, 719; 430/5
See application file for complete search history.

(56) References Cited

U.S. PATENT DOCUMENTS 5,378,137 A * 1/1995 Asakawa et al. ..... 425/174.4
5,417,897 A 5/1995 Asakawa et al.
5,883,644 A * 3/1999 Nicoloff et al. ..... 347/12
6,426,481 B1 * 7/2002 Koide et al. ..... 219/121.71
2001/0007171 A1 7/2001 Kinoshita
2001/0012696 A1 * 8/2001 Minakuti et al. ..... 438/707
2002/0074321 A1 6/2002 Ellenkamp
2003/0136771 A1 7/2003 Ellenkamp
2004/0021731 A1 2/2004 Yabe et al.
2004/0085411 A1 5/2004 Takahashi et al.
2004/0183867 A1 9/2004 Hirota (Continued)

FOREIGN PATENT DOCUMENTS

CN 1453130 A 11/2003

(Continued)

OTHER PUBLICATIONS

European Patent Office, European Search Report for EP Appl'n No. 06020314.8-2304 (counterpart to the above-captioned U.S. patent appl'n) dated Mar. 19, 2008.

*Primary Examiner*—Nadine Norton
*Assistant Examiner*—Maki Angadi
(74) *Attorney, Agent, or Firm*—Baker Botts L.L.P.

(57) ABSTRACT

For forming a group or rows of nozzles in a substrate of an ink-jet head, firstly, a laser irradiation source and a masking material in which a plurality of holes arranged in two rows are formed, are arranged on an upper side of a position at which one group of rows of nozzles of the substrate is formed. Next, an ultraviolet laser is irradiated from an upper side of the masking material, and a laser which has passed through the masking material is irradiated on the substrate. Two rows of nozzles are formed in a portion of the substrate at which the ultraviolet laser is irradiated. Accordingly, by irradiation of the laser once, it is possible to form a plurality of nozzles arranged in a row.

11 Claims, 12 Drawing Sheets

U.S. PATENT DOCUMENTS

| | | | |
|---|---|---|---|
| 2005/0104938 | A1 | 5/2005 | Mita et al. |
| 2005/0179743 | A1 | 8/2005 | Hirota et al. |
| 2007/0013749 | A1 | 1/2007 | Hirota |

FOREIGN PATENT DOCUMENTS

| | | | | |
|---|---|---|---|---|
| CN | 1654210 | A | | 8/2005 |
| EP | 0 624 471 | A2 | | 11/1994 |
| EP | 1211077 | | * | 5/2002 |
| EP | 1 211 077 | A1 | | 6/2002 |
| EP | 1 459 898 | A2 | | 9/2004 |
| EP | 1 564 001 | A2 | | 8/2005 |
| JP | H07-108687 | A | | 4/1995 |
| JP | 2000-334944 | A | | 12/2000 |
| JP | 2003-251811 | A | | 9/2003 |

* cited by examiner

METHOD OF PRODUCING NOZZLE PLATE AND METHOD OF PRODUCING LIQUID-DROPLET JETTING APPARATUS

CROSS REFERENCE TO RELATED APPLICATION

The present application claims priority from Japanese Patent Application No. 2005-286087, filed on Sep. 30, 2005, the disclosure of which is incorporated herein by reference in its entirely.

BACKGROUND OF THE INVENTION

1. Field of the Invention

The present invention relates to a method of producing a liquid-droplet jetting apparatus which jets a liquid droplet from a nozzle, and a method of producing a nozzle plate which constructs the liquid-droplet jetting apparatus.

2. Description of the Related Art

As an ink-jet head which jets an ink from a nozzle, there is an ink-jet head in which a plurality of nozzles is arranged to form a plurality of nozzle rows each extending in a predetermined direction. For example, in an ink-jet printer head (ink-jet head) described in Japanese Patent Application Laid-open No. 2003-251811 (FIGS. 11 and 12), a plurality of nozzles are arranged, in a nozzle plate made of a synthetic resin material, in one direction to form two nozzle rows, and the two nozzle rows are arranged closely. Further, these nozzles are formed by laser machining (processing) by a laser such as an excimer laser, a YAG (YttriumAluminumGarnet) laser, and a carbon dioxide gas laser.

SUMMARY OF THE INVENTION

In the ink-jet head described in Japanese Patent Application Laid-open No. 2003-251811, however, when the nozzles are made one by one separately by the laser machining (processing), it requires much time and labor. Further, as the number of nozzles included in each of the nozzle rows is increased, and/or as the number of nozzle rows is increased, more time and labor is required for forming the nozzles.

An object of the present invention is to provide a method of producing liquid-droplet jetting apparatus having a simple producing process, a method of producing a nozzle plate which can be produced with a simple producing process, a nozzle plate which can be produced easily, and a liquid-droplet jetting apparatus which can be produced easily.

According to a first aspect of the present invention, there is provided a method of producing a nozzle plate, the method including:

- a step for providing a substrate and a masking material which has a mask hole row group formed in the masking material and including a plurality of mask hole rows each of which is formed of a plurality of mask holes arranged in a first direction and which are aligned in a second direction orthogonal to the first direction;
- a masking material moving step for moving the masking material to a position above a predetermined position on a surface of the substrate; and
- a nozzle row group forming step for performing a laser irradiation sub-step for irradiating a laser onto the surface of the substrate from a side of a surface of the masking material opposite to the substrate, and forming, in the substrate, a plurality of nozzle row groups including a plurality of nozzle rows each of which has a plurality of nozzles arranged in an array in the first direction and which are aligned in the second direction.

Accordingly, by the nozzle row group forming step, a plurality of nozzle rows included in one nozzle row group is formed at the same time. Therefore, it is possible to easily form a nozzle plate provided with a plurality of nozzle rows, each of which has a plurality of nozzles arranged in an array or row, and which are aligned in a direction orthogonal to the row direction so as to form a plurality of nozzle row groups in the nozzle plate.

In the method of producing the nozzle plate of the present invention, the nozzle row groups may be formed by repeatedly performing the masking material moving step and the nozzle row group forming step. In this case, by repeatedly performing the masking material moving step and the nozzle row group forming step, it is possible to form the nozzle row groups efficiently. Therefore, the nozzle row groups can be formed easily.

In the method of producing the nozzle plate of the present invention, in the nozzle row group forming step, the nozzle row groups may be formed by an ultraviolet laser. Accordingly, it is possible to perform laser irradiation with a uniform energy density in a comparatively wide area by the ultraviolet laser. Accordingly, it is possible to form accurately the nozzle rows included in each of the nozzle row groups, in the laser irradiation sub-step.

In the method of producing the nozzle plate of the present invention, a length of the mask hole row group in the second direction may be not more than 2 mm. Alternatively, a length of the mask hole row group, of the masking material, in the first direction may be not more than 20 mm. In these cases, since the laser is irradiated, with substantially uniform energy density, onto the mask holes in each of the mask hole rows of the masking material, it is possible to accurately form the nozzle row groups in the substrate.

In the method of producing the nozzle plate of the present invention, the nozzle row group forming step may include the laser irradiation sub-step, and a step for repeating the laser irradiation sub-step, after moving the masking material in the first direction, so as to form a nozzle row group which is longer with respect to the first direction than the nozzle row groups. In this case, in a case of forming a nozzle row group, having a length longer with respect to the first direction than a length up to a certain limit at which the laser can be irradiated with the uniform energy density, in other words, even in a case in which such a long nozzle row group cannot be formed wholly at a time by performing the laser irradiation step once, it is possible to easily form such a long nozzle row group in the nozzle row group forming step.

In the method of producing the nozzle plate of the present invention, the substrate may be made of polyimide. In this case, the processing (machining) of the substrate is easy, and it is possible to form the nozzle easily, particularly in the laser radiation step.

In the method of producing the nozzle plate of the present invention, the laser may be an excimer laser. In these cases, since it is possible to irradiate an ultraviolet laser having a high energy density, the processing (machining) of the substrate becomes easy.

In the method of producing the nozzle plate of the present invention, the masking material may include a glass substrate made of quartz, and a chromium layer which is formed on a surface of the glass substrate. In this case, it is possible to form the mask holes accurately by a photolithography method.

In the method of producing the nozzle plate of the present invention, the mask holes in each of the mask hole rows may be formed at a predetermined spacing distance in the first direction; and the mask hole rows may be arranged to be mutually shifted in the first direction. In this case, it is possible to form the nozzles arranged highly densely regarding the first direction.

In the method of producing the nozzle plate of the present invention, two adjacent mask hole rows, among the mask hole rows, may be shifted from each other by an amount of ¼ of the predetermined spacing distance. In this case, it is possible to form the nozzles which are formed highly densely, and arranged at same spacing distance, with respect to the first direction.

According to a second aspect of the present invention, there is provided a method of producing a liquid-droplet jetting apparatus, including:

a step for providing a first plate;

a step for forming a channel unit by forming a plurality of pressure chambers in the first plate, and by joining the first plate and a nozzle plate which is produced with the method of the present invention and which has a plurality of nozzles corresponding to the pressure chambers respectively, so as to form the channel unit in which the pressure chambers are communicated with the nozzles respectively;

a step for arranging a second plate such that the second plate covers the pressure chambers;

a step for forming a piezoelectric layer on a surface of the second plate on a side opposite to the pressure chambers;

a step for forming a plurality of individual electrodes, on a surface of the piezoelectric layer on a side opposite to the pressure chambers, such that the individual electrodes face the pressure chambers respectively; and by drawing a plurality of first contact points, from the individual electrodes respectively, up to areas at which the contact points do not overlap with the pressure chambers, respectively;

a step for forming a common electrode, which faces the individual electrodes, on a surface of the piezoelectric layer on a side of the pressure chambers; and a step for joining a wiring member, which has a plurality of second contact points and which applies drive voltage to each of the individual electrodes, to the channel unit by connecting the second contact points to the first contact points, respectively.

In this case, since all the first contact points of the individual electrodes are drawn in the same direction, a spacing distance between the first contact points is not decreased locally. Therefore, it is possible to avoid the second contact points of the wire members provided corresponding to the first contact points and a wiring pattern from being arranged densely and locally, thereby making it possible to reduce the producing cost of the wiring member. Moreover, it becomes easy to connect the first contact points of the individual electrodes and the second contact points of the wiring member.

DETAILED DESCRIPTION OF THE PREFERRED EMBODIMENTS

An exemplary embodiment of the present invention will be described below referring to the accompanying diagrams. This embodiment is an example in which the present invention is applied to a method of producing an ink-jet head which jets ink from nozzles.

Figure 1:
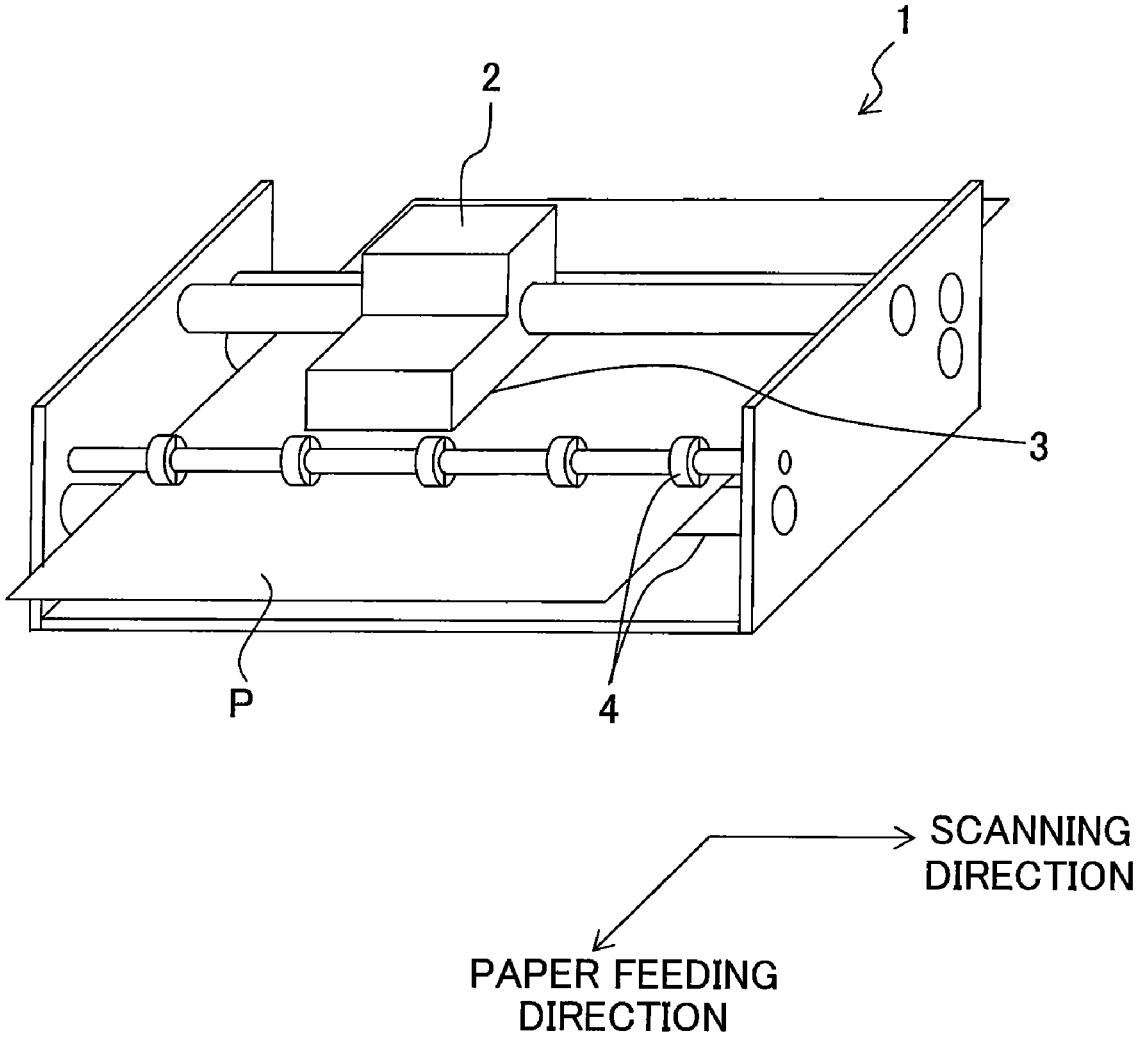
FIG. 1 is a schematic perspective view of an ink-jet printer according to an embodiment of the present invention.

FIG. 1 is a schematic perspective view of an ink-jet printer according to the embodiment. As shown in FIG. 1, an ink-jet printer 1 includes a carriage 2 which is movable in a scanning direction (left and right direction in FIG. 1), an ink-jet head 3 of serial type which is installed on the carriage 2, and jets ink on to a recording paper P, and paper transporting rollers 4 which carry the recording paper P in a forward direction in FIG. 1 (paper feeding direction). The ink-jet head 3, prints an image on the recording paper P by jetting an ink from a nozzle 15 (refer to FIG. 2) on a lower surface of the carriage 2 while moving integrally with the carriage 2. Moreover, the recording paper P with an image printed thereon by the ink-jet head 3 is discharged in the paper feeding direction by the paper transporting rollers 4.

Figure 2:
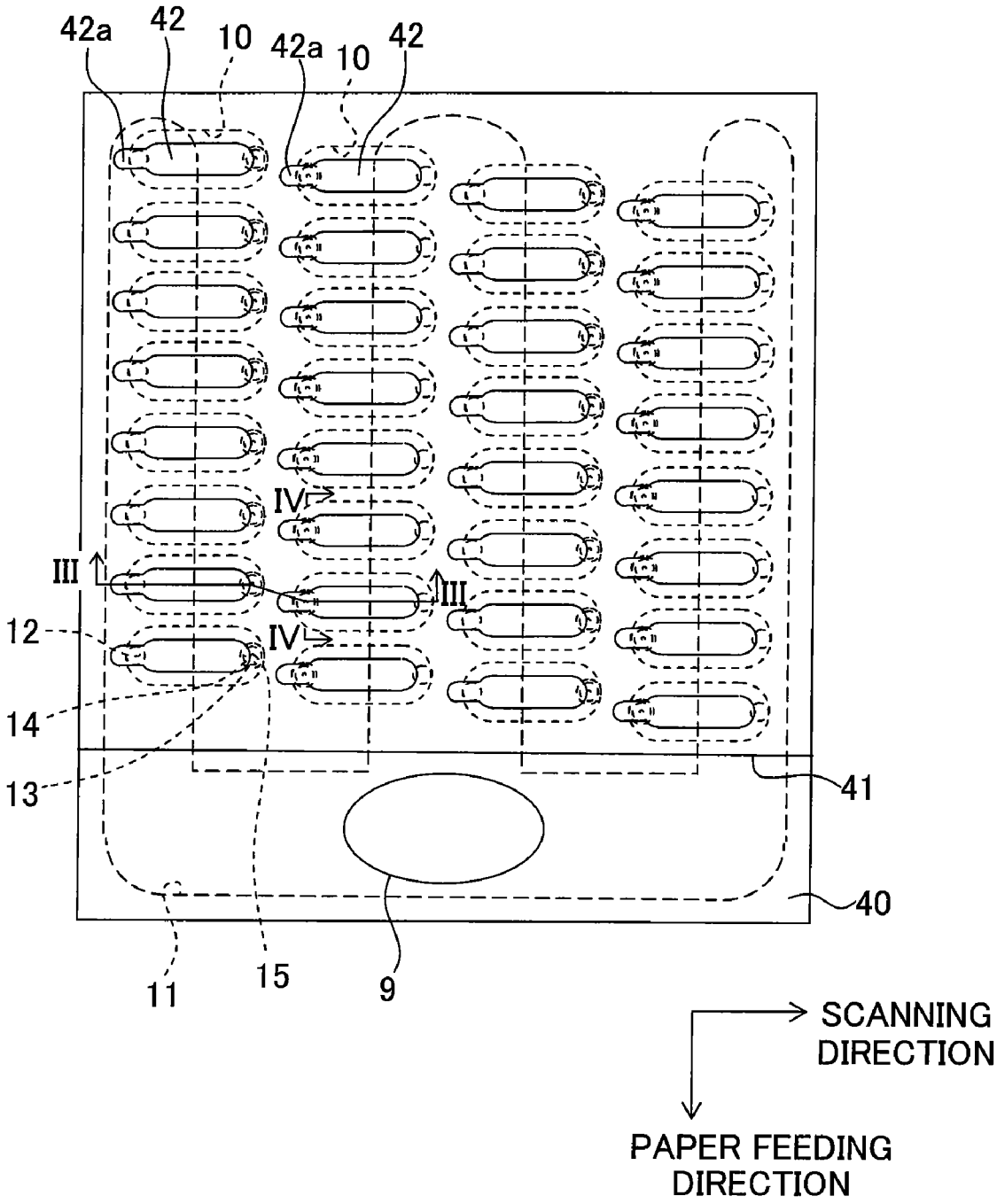
FIG. 2 is a plan view of an ink-jet head in FIG. 1.
Figure 3:
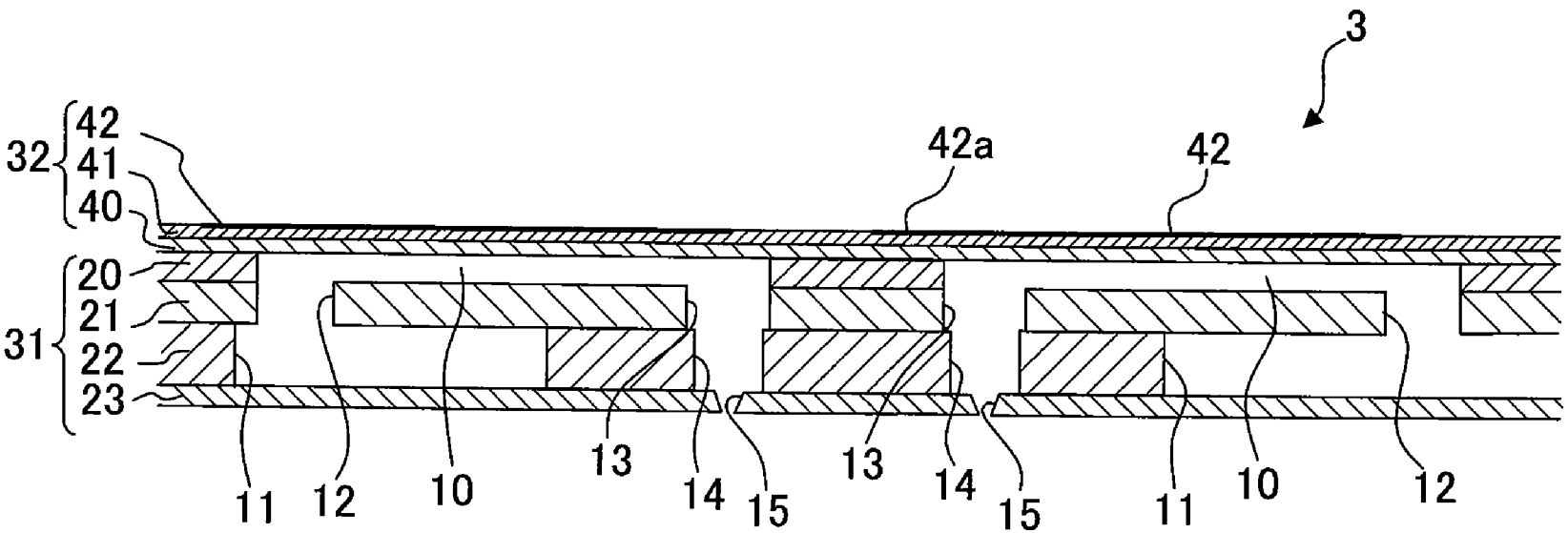
FIG. 3 is a cross-sectional view taken along a line III-III in FIG. 2.
Figure 4:
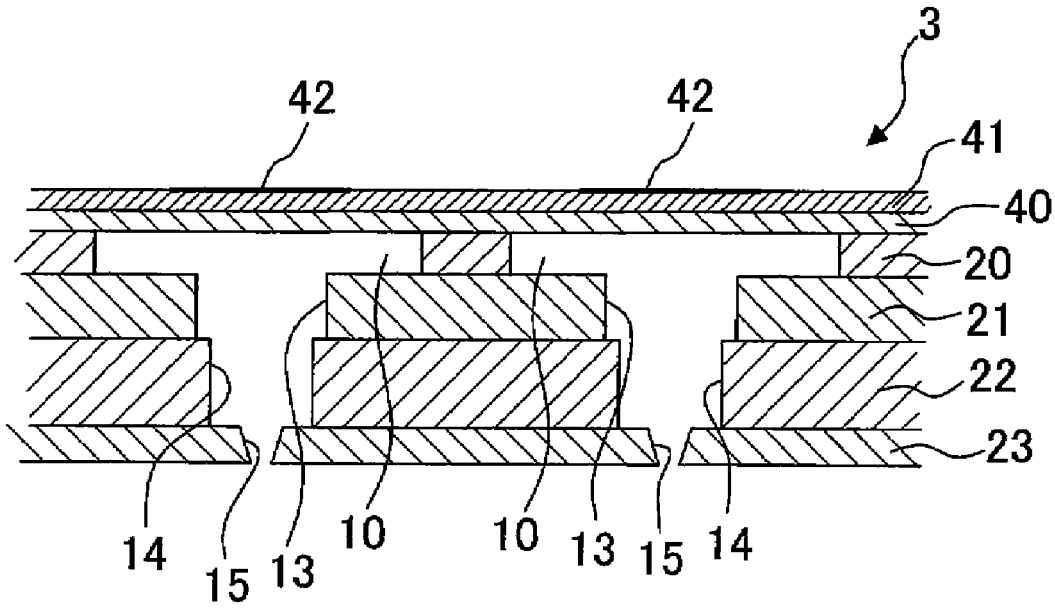
FIG. 4 is a cross-sectional view taken along a line IV-IV in FIG. 2.

Next, the ink-jet head 3 will be described below with reference to FIGS. 2 to 5. As shown in FIGS. 2 to 4, the ink-jet head 3 includes a channel unit 31 in which a plurality of individual ink channels including a plurality of pressure chambers 10, is formed, and a piezoelectric actuator 32 which is arranged on an upper surface of the channel unit 3, and applies pressure to the ink in the pressure chamber 10.

The channel unit 31 includes a cavity plate 20, a base plate 21, a manifold plate 22, and a nozzle plate 23, and these four plates 20 to 23 are joined in stacked layers. Among these four plates, the three plates 20 to 22, except the nozzle plate 23, are formed of a metallic material such as stainless steel, and ink channels such as a manifold channel 11 and the pressure chambers 10, which will be described later, are formed by a method such as an etching. Moreover, the nozzle plate 23 is formed of a synthetic resin material such as polyimide, and is adhered to a lower surface of the manifold plate 22.

As shown in FIG. 2 to FIG. 4, a plurality of pressure chambers 10 is formed in the cavity plate 20, and these pressure chambers 10 form four rows of pressure chambers arranged in a paper feeding direction (vertical direction in FIG. 2). Each pressure chamber 10 is substantially elliptical with a longitudinal axis in the scanning direction (left and right direction in FIG. 2). In the base plate 21, communicating holes 12 are formed at positions overlapping in a plan view with a left end portion in a longitudinal direction of the pressure chambers 10 belonging to a first row of pressure chambers and a third row of pressure chambers from a left side in FIG. 2, as well as at positions overlapping in a plan view with a right end portion in the longitudinal direction of the pressure chambers 10 belonging to a second row of pressure chambers and a fourth row of pressure chambers from the left side in FIG. 2. Moreover, in the base plate 21, communicating holes 13 are formed at positions overlapping in a plan view, with an end portion of the pressure chamber 10 in the longitudinal direction, on a side opposite to the communicating hole 12.

In the manifold plate 22, the manifold channel 11 which is extended upon being divided into three (manifold channels) in the paper feeding direction is formed. Among these three (manifold channels), the manifold channel 11 at a right end and a left end in FIG. 2, are arranged to overlap in a plan view, roughly a left half portion of the pressure chambers 10 belonging to the first row of the pressure chambers from the left side in FIG. 2, and roughly a right half portion of the pressure chambers 10 belonging to the fourth row of the pressure chambers (from the left side in FIG. 2). The manifold channel 11 at the center in FIG. 2 is arranged to overlap in a plan view, roughly a right half portion of the pressure chambers 10 belonging to the second row of pressure chambers 10 from the left side in FIG. 2, and roughly a left half portion of the pressure chambers 10 belonging to the third row of pressure chambers (from the left side in FIG. 2). Moreover, a width of the manifold channel 11 at the center is more than a width of the two manifold channels 11 on two sides. Furthermore, ink is supplied to the manifold channel 11 from an ink supply port 9 formed in a vibration plate 40 which will be described later. Moreover, communicating holes are formed in the manifold plate 22, in an area overlapping a plan view, with the communicating holes 13.

Figure 5:
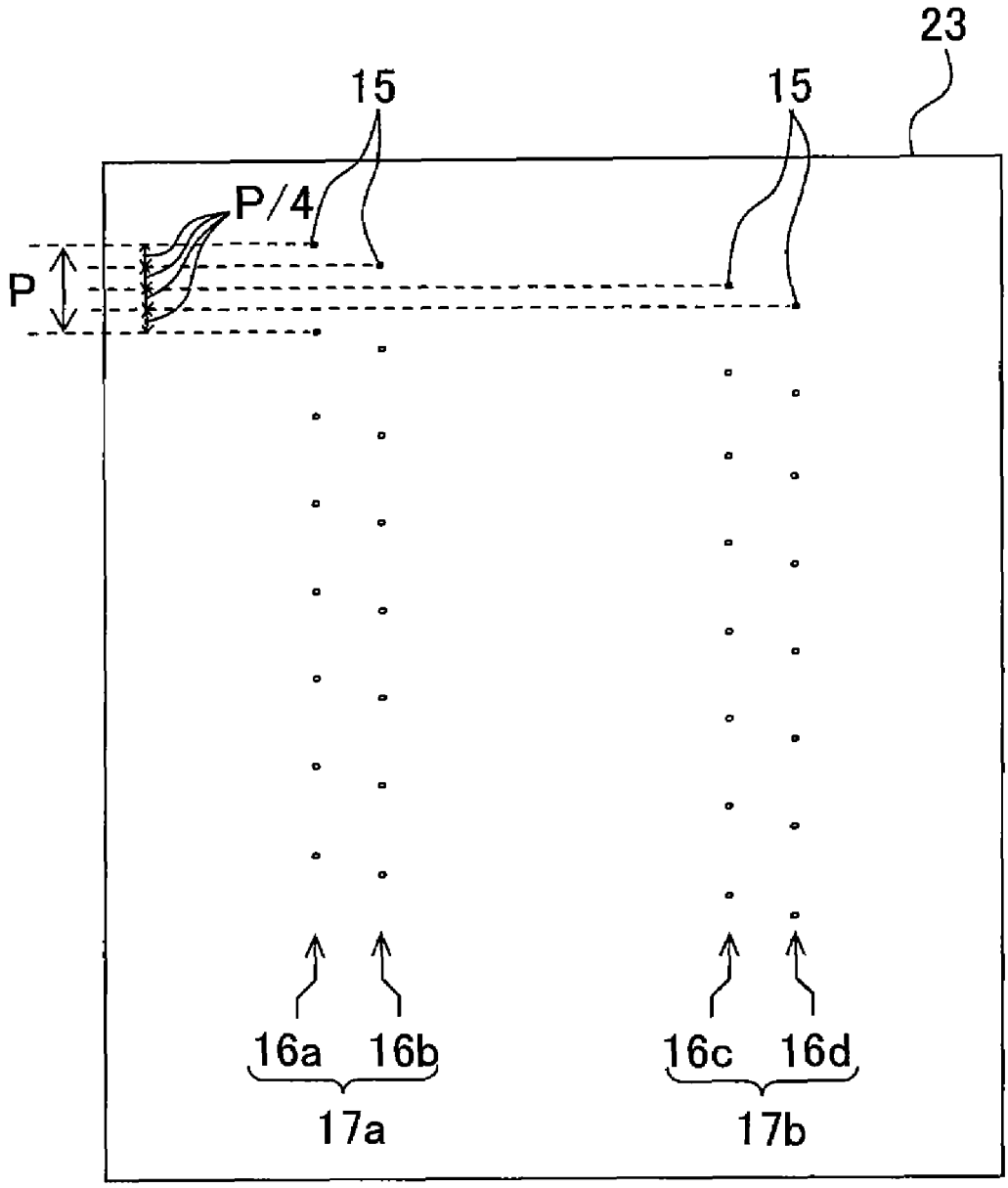
FIG. 5 is a plan view of a nozzle plate in FIG. 3.

A plurality of nozzles 15 is formed in the nozzle plate 23, in an area overlapping with the communicating holes 14 in a plan view. The nozzles 15 form four nozzle rows 16*a* to 16*d* arranged at an interval P in the feeding direction (vertical direction in FIG. 5, a first direction). Furthermore, the nozzle rows 16*a* and 16*b*, and the nozzle rows 16*c* and 16*d* are arranged closely with respect to the scanning direction (left and right direction in FIG. 5, a second direction), and form a nozzle row group 17*a* and a nozzle row group 17*b*. Moreover, as shown in FIG. 5, the nozzles 15 included in the nozzle row 16*a* and the nozzles 15 included in the nozzle row 16*b*, and the nozzles 15 included in the nozzle row 16*c* and the nozzles 15 included in the nozzle row 16*d* are arranged to be shifted by an interval P/4 with respect to the paper feeding direction respectively. Moreover, as shown in FIG. 5, the nozzle row group 17*a* and the nozzle row group 17*b* which are adjacent, are arranged to be mutually isolated (separated) with respect to the scanning direction, and the nozzles 15 included in the nozzle row groups 17*a* and 17*b* are arranged to be misaligned (shifted) by an interval P/2 with respect to the paper feeding direction respectively. Thus, since the nozzles 15 are arranged at a pitch of P/4 each with respect to the paper feeding direction, as compared to a case in which the positions of nozzles 15 with respect to the paper feeding direction, between the four nozzle rows of the nozzles coincide, the nozzles 15 are arranged highly densely with respect to the paper feeding direction. Such nozzles 15, as it will be described later, can be formed by irradiating an ultraviolet laser such as an excimer laser on the nozzle plate 23.

Moreover, as shown in FIG. 3, the manifold channels 11 communicate with the pressure chambers 10 via the communicating holes 12, and the pressure chambers 10 communicate with the nozzles 15 via the communicating holes 13 and 14. Thus, a plurality of individual ink channels from the manifold channel 11 up to each nozzle 15 via each pressure chamber 10, are formed in the channel unit 31.

Next, the piezoelectric actuator 32 will be described below. The piezoelectric actuator 32 includes the vibration plate 40 which is arranged on an upper surface of the channel unit 31, a piezoelectric layer 41 which is formed on an upper surface of the vibration plate 40, and a plurality of individual electrodes 42 formed corresponding the pressure chambers 10, on an upper surface of the piezoelectric layer 41.

The vibration plate 40 is a plate having a substantially rectangular shape in a plan view, and is made of a material such as an iron alloy like stainless steel, a copper alloy, a nickel alloy, or a titanium alloy. The vibration plate 40 is arranged on an upper surface of the cavity plate 20, to cover the pressure chambers 10, and is joined to the cavity plate 20. The vibration plate 40 made of a metallic material is electroconductive, and also serves as a common electrode which generates an electric field in the piezoelectric layer 41 sandwiched between the individual electrode 42 and the vibration plate 40. The vibration plate 40 is always kept at a ground electric potential.

As shown in FIGS. 3 and 4, the piezoelectric layer 41 which is composed of mainly lead zirconate titanate (PZT) which is a solid solution of lead titanate and lead zirconate, and is a ferroelectric substance, is formed on the upper surface of the vibration plate 40. The piezoelectric layer 41 is formed continuously over the pressure chambers 10. The piezoelectric layer 41 can be formed by an aerosol deposition (AD method) in which, very fine particles of a piezoelectric material are deposited on a surface of a substrate by allowing to collide at a high speed by spraying on the substrate. Moreover, the piezoelectric layer 41 can also be formed by a sputtering method, a chemical vapor deposition (CVD method), a sol-gel method, and a hydrothermal synthesis method. Or, the piezoelectric layer can also be formed by cutting to a predetermined size a piezoelectric sheet which is obtained by baking a green sheet of PZT, and adhering on the upper surface of the vibration plate 40.

The individual electrodes 42 which are substantially elliptical in shape, and slightly smaller than the pressure chamber 10, are formed on the upper surface of the piezoelectric layer 41, at positions overlapping with the pressure chambers 10 in a plan view. The individual electrodes 42 are made of an electroconductive material such as gold, copper, silver, palladium, platinum, and titanium. End portion on the left side in FIG. 2 of the individual electrodes 42 are drawn through a same distance, up to an area not overlapping with the pressure chambers 10 in a plan view, and this portion forms a contact point (first contact point) 42*a*. The individual electrode 42 and the contact point 42*a* are formed by a method such as a screen printing, and the sputtering method.

Figure 6:
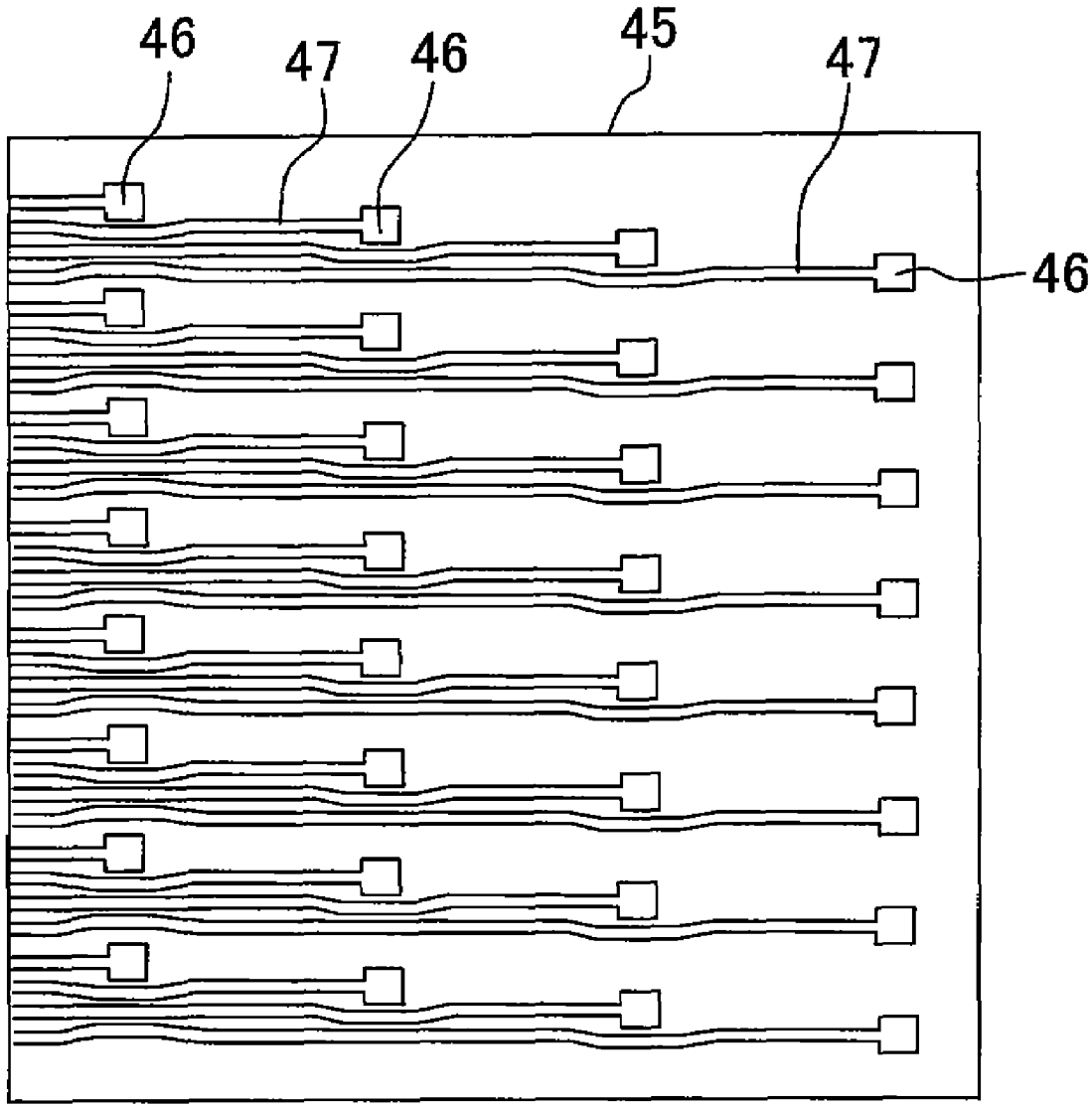
FIG. 6 is a plan view of an FPC arranged above an upper surface of the ink-jet head in FIG. 2.

A flexible printed circuit (FPC) (wiring member) 45 as shown in FIG. 6, is formed on an upper surface of the piezoelectric actuator 32. A contact point (second contact point) 46 having a substantially rectangular shape which electrically connects to the contact point 42*a*, and a wire 47 extended from each contact point 46, toward a left side in FIG. 6, are formed in a portion overlapping with the contact point 42*a* in a plan view. The wire 47 is electrically connected to a driver IC which is not shown in the diagram, and an electric potential of the individual electrode 42 is controlled by the driver IC via the wire 47 and the contact point 46. In other words, a drive voltage is supplied to the individual electrode 42 via the driver IC.

Here, the contact point 42*a* is drawn through the same distance in the same direction from each individual electrode 42. As shown in FIG. 2, since the contact points 42*a* are arranged uniformly, the contact points 42*a* are not arranged with an interval which is narrowed locally. Consequently, as shown in FIG. 6, in the FPC 45 arranged on the upper surface of the piezoelectric actuator 32, it is possible to avoid the contact points 46 connected to the contact points 42*a* and/or the wires 47 connected to the contact points 46 being arranged densely locally, and to reduce a producing cost of the FPC 45. Moreover, the contact point 42*a* of the individual electrode 42, and the contact point 46 of the FPC 45 can be connected easily.

Next, an action of the ink-jet head 3 will be described below. When a predetermined electric potential is selectively applied to the individual electrodes 42 by the driver IC, an electric potential difference is developed between the individual electrode 42 to which the predetermined electric potential is applied, and the vibration plate 40 serving as the common electrode, which is kept at the ground electric potential. When the electric potential difference is developed, an electric field in a direction of thickness is generated in the piezoelectric layer 41 in a portion sandwiched between this individual electrode 42 and the vibration plate 40. When a direction of the electric field is same as a direction in which the piezoelectric layer 41 is polarized, the piezoelectric layer 41 is contracted in a horizontal direction which is orthogonal to the direction of thickness of the piezoelectric layer 41. With the contraction of the piezoelectric layer 41, the vibration plate 40 is deformed to be projected toward the pressure chamber 10, and a volume of the pressure chamber 10 is decreased. Due to the decrease in the volume of the pressure chamber 10, a pressure on the ink in the pressure chamber 10 is increased, and ink is jetted from the nozzle 15 communicating with the pressure chamber 10.

Next, a method of producing such ink-jet head 3 will be described below by referring to FIGS. 7 to 9.

Figure 7A:
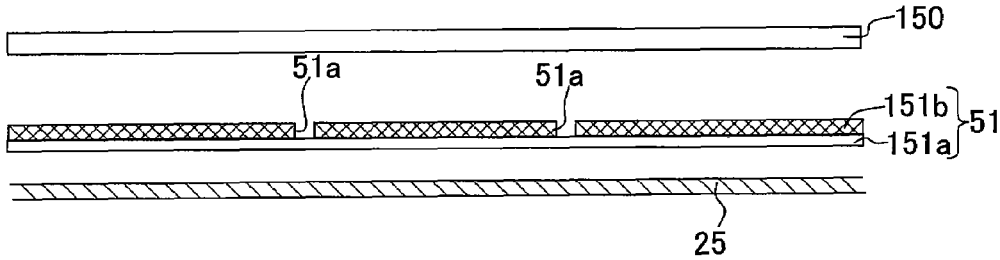
FIG. 7A is a cross-sectional view of a producing process of the ink-jet head in FIG. 2, in which, a step of moving a masking material is shown.
Figure 8A:
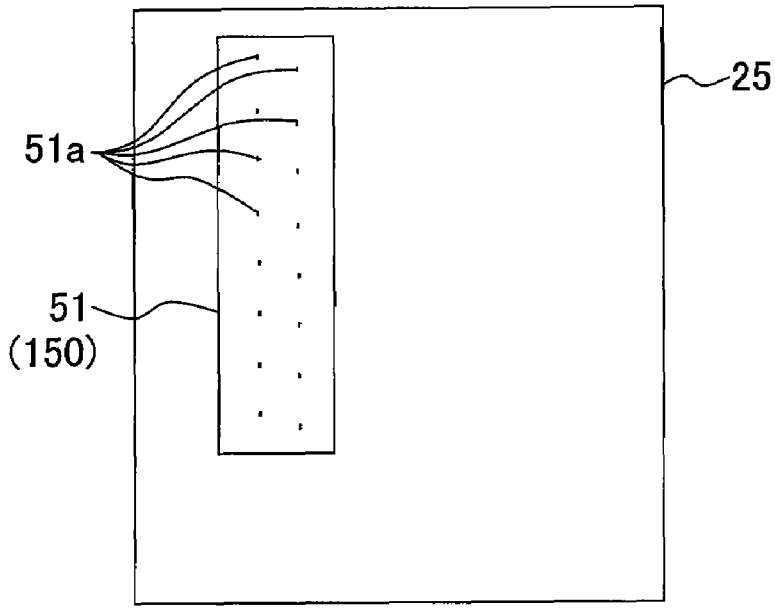
FIG. 8A is a plan view of the producing process of the ink-jet head in FIG. 2, in which, the step of moving the masking material performed for a first time is shown.

For producing the ink-jet head 3, firstly, as shown in FIG. 7A and FIG. 8A, on an upper side of a portion of a substrate 25 which becomes the nozzle plate 23, in which the nozzle row group 17*a* is formed, a masking material 51 in which a plurality of holes 51*a* are arranged in two rows in a vertical direction in FIG. 8, and a laser irradiation source (150) which irradiates a laser are arranged (step of moving a masking material). The masking material 51 and the laser irradiation source 150 can be moved while maintaining a mutual positional relationship.

Figure 7B:
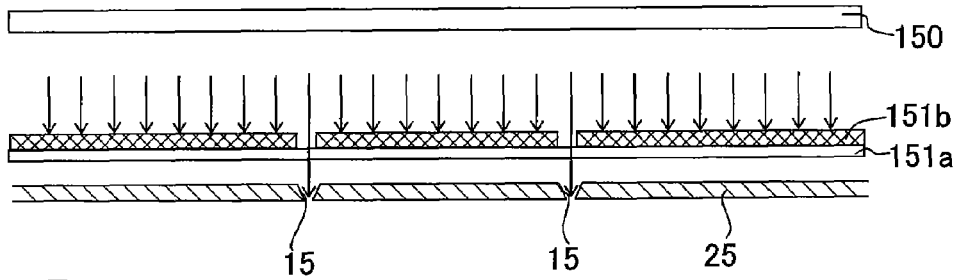
FIG. 7B is a cross-sectional view of the producing process of the ink-jet head in FIG. 2, in which, a step of forming a group of nozzle rows of is shown.

Next, as shown in FIG. 7B, the laser is irradiated from an upper side (side opposite to the nozzle plate 23) of the masking material 51, toward the masking material 51 (step of irradiating laser, and step of forming a group of rows of nozzles). A laser beam is passed through the hole (mask hole) 51*a*, and is irradiated on an upper surface of the substrate. In a portion of the substrate 25 on which the laser is irradiated, the nozzles 15 arranged in two rows in the vertical direction in FIG. 8 (nozzle row, nozzle row group 17*a* (refer to FIG. 5)) are formed.

Figure 9A:
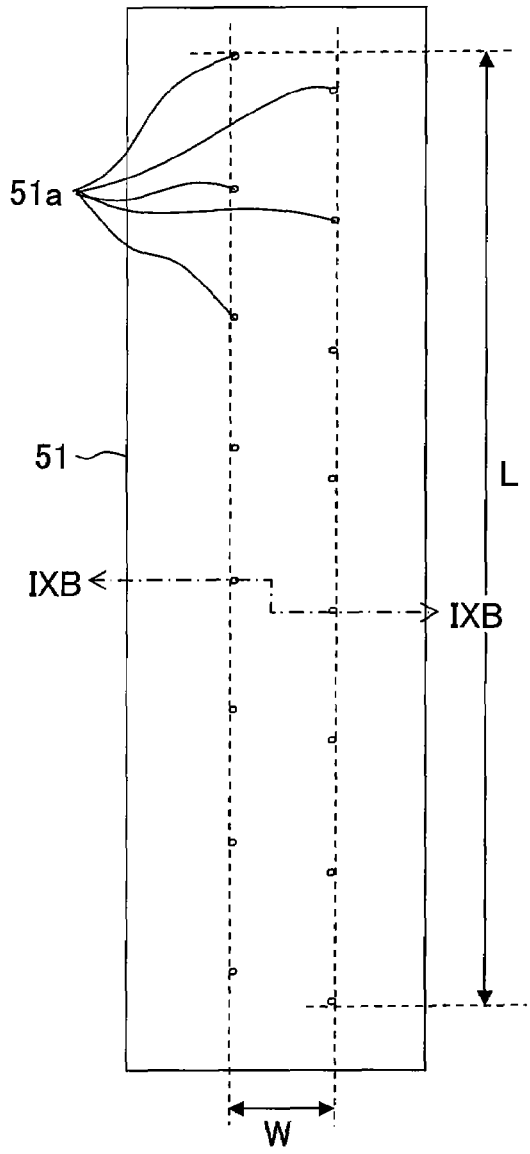
FIG. 9A is an enlarged plan view of the masking material in FIG. 7A.

Here, in a case of using a laser having a wavelength in an infrared area, such as a carbon dioxide gas laser and a YAG laser, for forming the nozzles 15, it is necessary to form the nozzles 15 one by one by melting and vaporizing the substrate by irradiating the beam upon narrowing, and the forming of the nozzles 15 is a troublesome task. In view of this, an ultraviolet laser such as an excimer laser is used in this embodiment. In this case, it is possible to gasify and turn into semi micron particles the substrate 25 by cutting off intermolecular bonds by allowing the substrate 25 to absorb energy instantaneously. Therefore, it is possible to irradiate the laser with a uniform energy density over a predetermined area, without a necessity to narrow the beam. Accordingly, when all the holes 51*a* in the masking material 51 are accommodated in this area, it is possible to form at the same time the nozzles 15 corresponding to the holes 51*a* by irradiating the laser once. In a case of the excimer laser, an area of a region on which the laser can be irradiated with the uniform energy density is about a width 2 mm×a length 20 mm, for example. Consequently, it is desirable that an entire width of the two rows of holes 51*a* of the masking material 51, in other words, a distance in a left and right direction in FIG. 9, between a left end of the holes 51*a* formed in a row on a left side and a right end of the holes 51*a* formed in a row on a right side, from among the holes 51*a* (mask hole rows) formed in two rows in the masking material, is not more than 2 mm, as shown in FIG. 9A. Further, it is desirable that a length L in a vertical direction in FIG. 9A between an upper end of the row of holes 51*a* on a left side in FIG. 9A and a lower end of the row of holes 51*a* on a right side in FIG. 9A is not more than 20 mm.

Figure 9B:
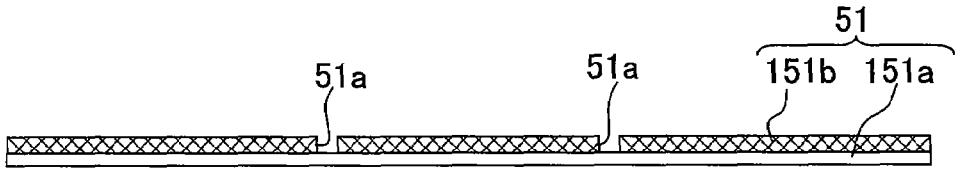
FIG. 9B is a cross-sectional view taken along a line IXB-IXB in FIG. 9A.

As shown in FIG. 9B, in the masking material 51, a chromium layer 152*b* is formed on a surface of a glass substrate 151*a* made of transparent quartz called as "mask blanker", and holes 51*a* are formed in a chrome-plated layer 151*b*. In a case of irradiating the ultraviolet laser on this masking material 51, the laser is shielded at an area in which the chromium layer 152*b* of the masking material 51 is formed, and the laser passes through an area in which the hole 51 is formed. The hole 51*a* is formed by a lithography method for example, in which an electron beam exposure is used.

Figure 8B:
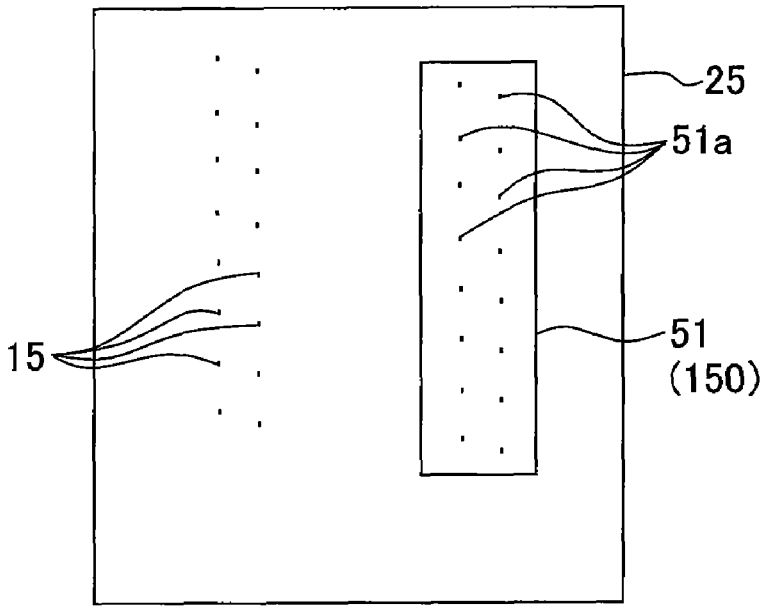
FIG. 8B is a plan view of the producing process of the ink-jet head in FIG. 2, in which, the step of moving the masking material performed for a second time is shown.

Next, as shown in FIG. 7A and FIG. 8B, the masking material 51 and the laser irradiation source 150 are moved toward an upper side of an area in which the nozzle row group 17*b* of the substrate 25 (refer to FIG. 5) is formed (step of moving the masking material). At this time, the nozzles 15 included in the nozzle row group 17*a* (refer to FIG. 5) and the nozzles included in the nozzle row group 17*b* (refer to FIG. 5) are arranged at positions which are shifted with respect to a direction of a row arrangement of nozzles. Consequently, the masking material 51 is moved toward a bottom right direction in FIG. 8B. Further, as shown in FIG. 7B, the laser is irradiated from the upper side of the masking material 51 (step of irradiating the laser), and the nozzles 15 included in the nozzle row group 17*b* (refer to FIG. 5) are formed.

Thus, by performing the step of moving the masking material and the step of irradiating the laser (step of forming a nozzle row group) twice repeatedly, the two nozzle row groups 17*a* and 17*b* (refer to FIG. 5) are formed one after another.

Figure 7C:
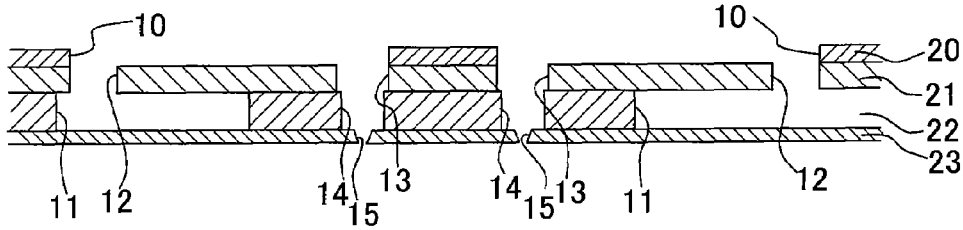
FIG. 7C is a cross-sectional view of the producing process of the ink-jet head in FIG. 2, in which, a step of forming a channel unit is shown.
Figure 7D:
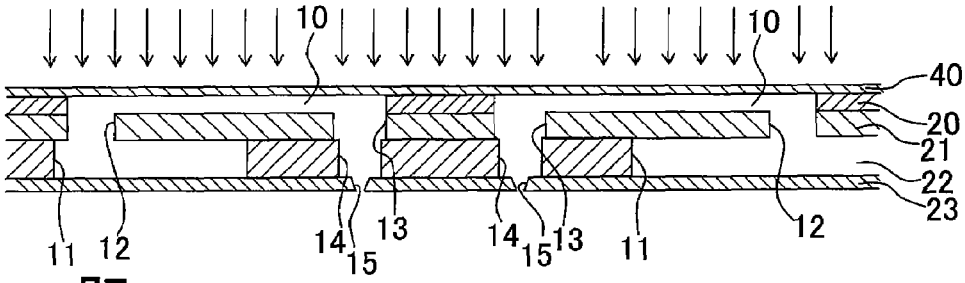
FIG. 7D is a cross-sectional view of the producing process of the ink-jet head in FIG. 2, in which a step of forming a piezoelectric layer and arranging a vibration plate is shown.
Figure 7E:
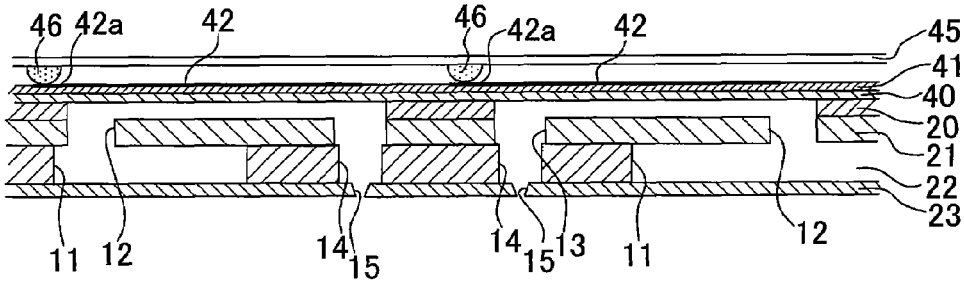
FIG. 7E is a cross-sectional view of the producing process of the ink-jet head in FIG. 2, in which, a step of connecting wiring members, and forming individual electrodes is shown.

As shown in FIG. 7C, the channel unit 31 is formed by joining in stacked layers, the nozzle plate 23 in which the nozzles 15 included in the two nozzle row groups 17*a* and 17*b* (refer to FIG. 5), and the plates 20 to 22 described above. As shown in FIG. 7D, the vibration plate 40 is arranged on the upper surface of the channel unit 31, and the piezoelectric layer is formed by the AD method. As shown in FIG. 7E, the individual electrodes 42 and the contact points 42*a* which are drawn from the individual electrodes 42 are formed on the surface of the piezoelectric layer 41 on a side opposite to the pressure chamber 10, and the piezoelectric actuator 32 is formed by connecting the contact points 42*a* and the contact points 46 of the FPC 45. Thus, the producing process of the ink-jet head 3 is completed. In this embodiment, since the vibration plate 40 is made of a metallic material, the vibration plate 40 also serves as the common electrode. However, when the vibration plate is formed of an insulating material, it is necessary to form an electroconductive layer of a metallic material etc. on a surface of the vibration plate, by a method such as the vapor deposition.

According to the embodiment described above, it is possible to form at a time, the nozzles 15 which form one nozzle row group, by the step of moving the masking material in which the masking material 51 is moved to the upper side of the nozzle plate 23, and the step of irradiating the laser in which the ultraviolet laser is irradiated from the upper side of the masking material 51. Moreover, it is possible to form easily the two nozzle row groups by performing repeatedly the step of forming the masking material and the step of irradiating the laser.

Furthermore, since it is possible to irradiate a laser having a uniform energy density on a comparatively wide area by using the ultraviolet laser such as the excimer laser, it is possible to form efficiently and accurately the nozzle rows 16*a* to 16*d* (nozzles 15) belonging to the nozzle row groups 17*a* and 17*b,* in the step of irradiating the laser.

Next, modified embodiments in which various modifications are made in the embodiment will be described below. Same reference numerals are assigned to components which have a similar structure as in the embodiment, and the description of such components is omitted.

First Modified Embodiment

As it has been described above, when the ultraviolet laser is used, it is possible to irradiate the laser with the uniform energy density over a comparatively wider area. However, when a length of the nozzle row group is longer than this area, it is not possible to form all the nozzle row groups in the step of irradiating the laser performed (only) once. In such case, firstly, at the step of moving the masking material, the masking material 51 is arranged to be positioned at a part on an upper side of a portion in which one nozzle row group is formed, and similarly as in the embodiment, after performing the step of irradiating the laser, the masking material 51 is moved in a direction in which the nozzles are arranged, and the laser is irradiated from the upper side of the masking material 51. One nozzle row group may be formed by performing such a series of operations once or for a plurality of times. As an example, as shown in FIG. 10, a case in which a length of a nozzle row group 67*a* formed by nozzle rows 66*a* and 66*b,* and a nozzle row group 67*b* formed by nozzle rows 66*c* and 66*d* is about twice a length up to certain limit (for example 20 mm) of an area in which the laser beam from the ultraviolet laser can be irradiated with the uniform energy density in this direction will be described below.

Figure 10A:
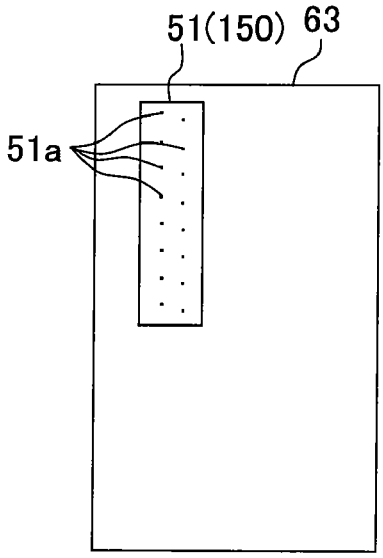
FIG. 10A to FIG. 10D are plan views of a producing process in a first modified embodiment, showing the step of moving the masking material for the first time up to for the fourth time, respectively.
Figure 10B:
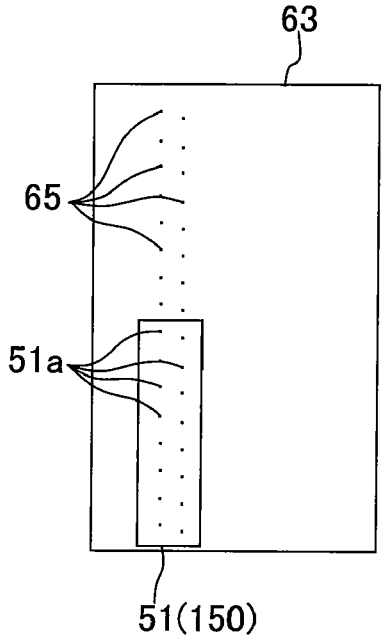

In this case, firstly, as shown in FIG. 10A, on an upper side of a substrate 63, the masking material 51 and a laser irradiation source are arranged at positions overlapping with an upper half portion of the nozzle row group 67*a* in a plan view (step of moving the masking material). Similarly as in the embodiment, a half of the nozzle row group 67*a* is formed by irradiating the ultraviolet laser such as the excimer laser on the masking material 51 from the upper side of the masking material 51 (step of irradiating the laser). Next, as shown in FIG. 10B, in a downward direction (first direction) in FIG. 10B, the masking material 51 and the laser irradiation source 150 are moved up to positions overlapping with a lower half portion of the nozzle row group 67*a* in a plan view, and a lower half portion (remaining portion) of the nozzle row group 67*a* is formed by irradiating the ultraviolet laser toward the masking material 51 from the upper side of the masking material 51.

Figure 10C:
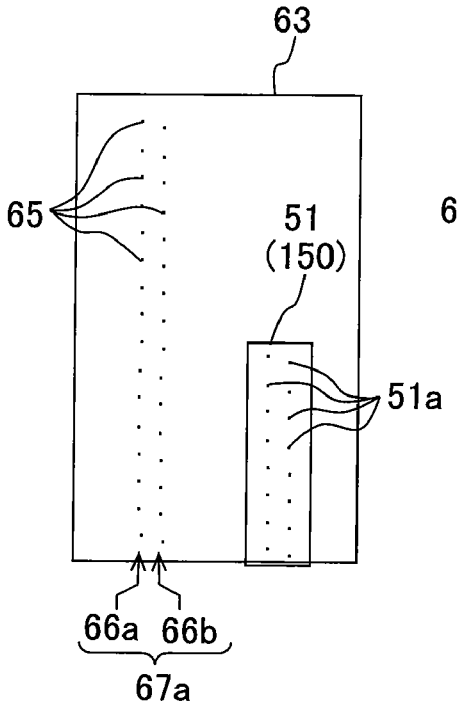

Next, as shown in FIG. 10C, the masking material 51 and the laser irradiation source 150 are moved to positions corresponding to an adjacent nozzle row group. In other words, the masking material 51 and the laser irradiation source 150 are moved to positions overlapping with a lower half portion of the nozzle row group 67*b* in a plan view (step of moving the masking material). Further, an upper half portion of the nozzle row group 67*b* is formed by irradiating the ultraviolet laser on the masking material 51 from the upper side of the masking material 51. In the step of moving the masking material, the masking material 51 may be moved to a position overlapping with an upper half portion of the nozzle row group 67*b* in a plan view. However, in a case of moving the masking material 51 to a position corresponding to the nozzle row group 67*b,* in other words to a position overlapping with the lower half portion of the nozzle row group 67*b,* a distance in a case through which the masking material 51 and the laser irradiation source 150 are moved is shorter than the distance in a case described earlier. Therefore, it is possible to shorten a time required for the step of moving the masking material, and to perform the formation of nozzles 65 efficiently.

Figure 10D:
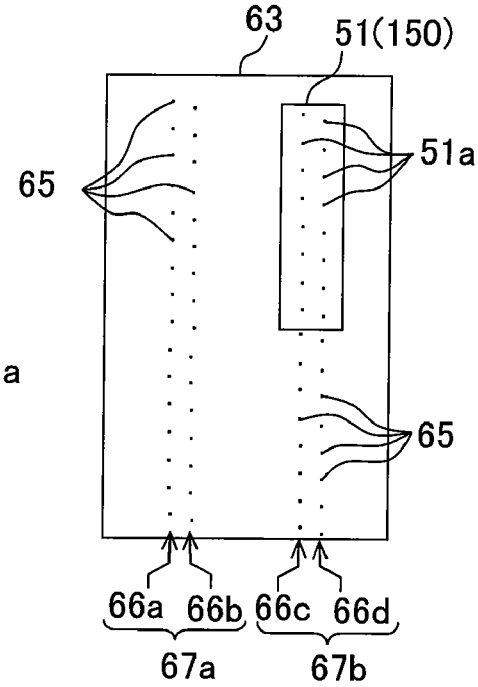

Next, as shown in FIG. 10D, the masking material 51 and the laser irradiation source 150 are moved in an upward direction (first direction) in FIG. 10D, and arranged at positions overlapping with the upper half portion of the nozzle row group 67*b* in a plan view. The upper half portion (remaining portion) of the nozzle row group 67*b* is formed by irradiating the ultraviolet laser on the masking material 51 from the upper side of the masking material 51.

Thus, when a length of the nozzle row groups 67*a* and 67*b* is long (substantial), it is possible to form easily the nozzle row groups 67*a* and 67*b* by moving the masking material 51 and the laser irradiation source 150 in a direction in which the nozzles 65 are arranged, after the step of moving the masking material and the step of irradiating the laser, and then irradiating the ultraviolet laser from the upper side of the masking material 51. When a length of a nozzle row group is longer than the length of the nozzle row groups 67*a* and 67*b* in FIG. 10, after the step of moving the masking material and the step of irradiating the laser, the masking material 51 is moved in the direction in which the nozzles 65 are arranged, and then the ultraviolet laser is irradiated toward the masking material 51 from the upper side of the masking material 51. The remaining part of the nozzle row group may be formed by repeating such series of steps for a plurality of times. Moreover, in the first modified embodiment, a series of steps including the first step of irradiating the laser, and the step of moving the masking material and the step of irradiating the laser which are performed once or repeatedly after the first step of irradiating the laser, becomes the nozzle row group forming step.

Second Modified Embodiment

Figure 11:
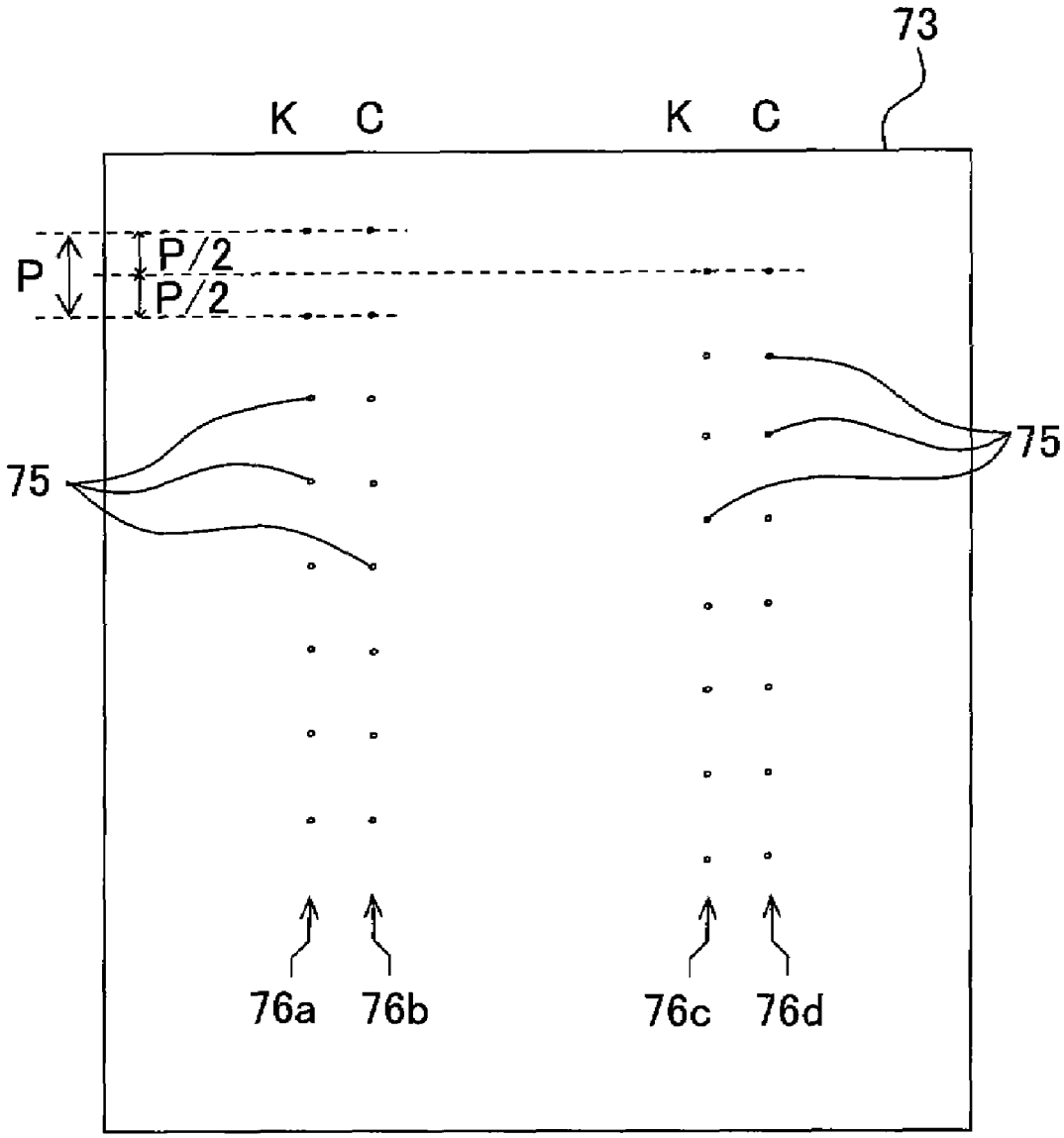
FIG. 11 is a plan view corresponding to FIG. 5, of a second modified embodiment.

In a case of an ink-jet head which jets inks of a plurality of colors, positions of nozzles which jet inks of various colors may coincide in a direction of arrangement of nozzles. In this case, for an ink of each color, it is possible to allow a landing position on the recording paper P (refer to FIG. 1) to match. For example, a description will show an example of a case of an ink-jet head which jets inks of two colors namely a black (K) ink and a cyan (C) ink as shown in FIG. 11. In a nozzle plate 73, a plurality of nozzles 75 included in a nozzle row 76*a* and a nozzle row 76*c* which jet the black ink are arranged to be shifted by P/2 with respect to a vertical direction in FIG. 11, and nozzle 75 included in a nozzle row 76*b* and a nozzle row 76*d* which jet the cyan ink are arranged to be shifted by P/2 with respect to the vertical direction in FIG. 11. The nozzles in the nozzle row 76*a* and the nozzle row 76*b*, and the nozzles in the nozzle row 76*c* and the nozzle row 76*d* may be arranged at the same position with respect to the vertical direction in FIG. 11. In this case, the nozzles 75 which jet the ink of same color are arranged at a pitch of P/2 with respect to the vertical direction in FIG. 11. Consequently, as compared to a case in which, between the nozzle rows 76*a* and 76*c*, and between the nozzle rows 76*b* and 76*d*, the positions of the nozzles 75 with respect to the vertical direction coincide (match), the nozzles 75 are arranged highly densely, with respect to the vertical direction in FIG. 11. Moreover, in a second modified embodiment, ink of colors other than black and cyan may also be jetted.

Third Modified Embodiment

Figure 12:
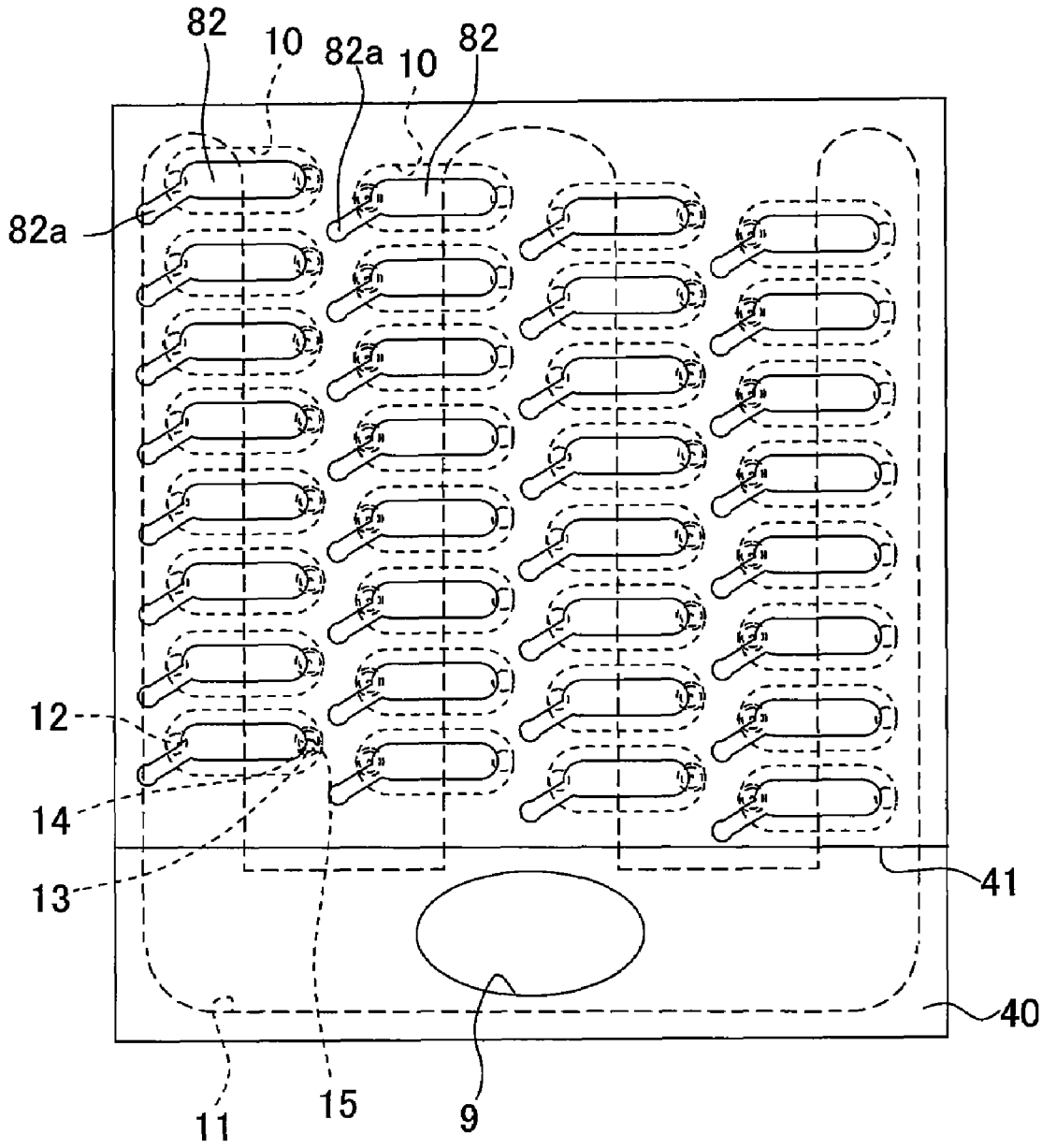
FIG. 12 is a plan view corresponding to FIG. 2, of a third modified embodiment.

As shown in FIG. 12, contact points 82*a* of individual electrodes 82 corresponding to the pressure chambers 10 arranged in a row may be extended toward bottom left side from the individual electrodes 82, and end portions of these contact points 82*a* may be positioned at a center of an area which is surrounded by the individual electrode 82, and three other individual electrodes 82 adjacent to this individual electrode 82, and positioned below, at top left, and at bottom left of this individual electrode 82. In FIG. 12, a contact point 82*a* of an individual electrode 82 corresponding to a lowermost pressure chamber in each pressure chamber row, and a contact point 82*a* of an individual electrode 82 corresponding to a pressure chamber 10 belonging to a pressure chamber row at extreme left, are also extended by the same length in a direction same as a direction of contact points 82*a* of the individual electrodes 82 other than this individual electrode 82.

In this case, a distance by which each contact point 82*a* and an individual electrode 82 positioned around this contact point 82*a* are separated becomes uniform, and the distance separating (isolating) the contact point 82*a* and the individual electrode 82 positioned around the contact point 82*a* is not decreased locally. Accordingly, at the time of connecting the FPC, the contact point 82*a* and the individual electrode 82 positioned around the contact point 82 are prevented from being connected mistakenly due to a flow of a solder up to these individual electrodes 82, and the contact points 82*a* and the FPC are connected easily.

The ink-jet head may have three or more nozzle row groups. In this case, it is possible to form a plurality of nozzle row groups by repeating the step of moving the masking material and the step of irradiating the laser three times or more than three times.

Moreover, each nozzle row group may be formed by three or more than three nozzle rows. In this case, by arranging the masking material 51 in which three or more than three rows of the holes 51*a* corresponding to the nozzle rows are formed, on a substrate of the nozzle plate 23, and by irradiating the ultraviolet laser from the upper side of the masking material 51, it is possible to form the nozzle rows simultaneously. However, as in the embodiment, when each nozzle row group includes two nozzle rows, since it is possible to form a channel such as the pressure chamber 10 communicating with a nozzle row, on a side opposite to a nozzle row which is arranged in proximity of this nozzle row, a structure of the channel becomes simple than in a case in which each nozzle row group includes three or more nozzle rows (refer to FIG. 3). Accordingly, there is a merit of a possible of reducing number of stacked plates and reducing producing cost.

In the embodiment, the nozzle 15 is formed by irradiating the ultraviolet laser passed through the hole 51*a* of the masking material 51 directly on the nozzle plate 23. However, a minification optical system such as a lens may be arranged between the masking material 51 and the nozzle plate 23, and the ultraviolet laser which has passed through the hole 51*a* may be irradiated on the substrate 25 via the minification optical system. In this case, a diameter of the nozzle 15 formed in the substrate 25 becomes smaller than (a diameter of) the hole 51*a*, and an interval between the nozzles 15 becomes smaller than an interval between the holes 51*a*. Consequently, holes 51*a* having a diameter larger than the diameter of the nozzle 15 may be formed in the masking material 51, at an interval greater than the interval between the nozzles 15, and the formation of the holes 51*a* becomes easy. At this time, since a magnitude of an error in a pattern developed while forming a pattern on the masking material 51, is also minified, it is possible to suppress an error in the diameter of the nozzle formed, to be small.

In this embodiment, an example in which the present invention is applied to the ink-jet head is described. Apart from this, the present invention is also applicable to a liquid-droplet jetting apparatus which jets a liquid other than ink such as a reagent, a biomedical solution, a wiring-material solution, an electronic-material solution, a solution for a cooling medium (refrigerant), and a solution for a fuel.

What is claimed is:

1. A method of producing a nozzle plate, the method comprising:

a step for providing a substrate and a masking material which has a mask hole row group formed in the masking material and including a plurality of mask hole rows each of which is formed of a plurality of mask holes arranged in a first direction and which are aligned in a second direction orthogonal to the first direction;

a masking material moving step for moving the masking material to a position above a predetermined position on a surface of the substrate; and a nozzle row group forming step for performing a laser irradiation sub-step for irradiating a laser onto the surface of the substrate from a side of a surface of the masking material opposite to the substrate, and forming, in the substrate, a plurality of nozzle row groups including a plurality of nozzle rows each of which has a plurality of nozzles arranged in an array in the first direction and which are aligned in the second direction, wherein in the laser irradiation sub-step, the laser is irradiated with a uniform energy density over a predetermined area and all of the mask holes in the masking material are accommodated in the predetermined area, and in the masking material moving step, the masking material and a laser irradiation source which irradiates the laser are moved while maintaining a mutual positional relationship of the masking material and the laser irradiation source.

2. The method of producing the nozzle plate according to claim 1, wherein the nozzle row groups are formed by repeatedly performing the masking material moving step and the nozzle row group forming step.

3. The method of producing the nozzle plate according to claim 1, wherein in the nozzle row group forming step, the nozzle row groups are formed by an ultraviolet laser.

4. The method of producing the nozzle plate according to claim 3, wherein a length of the mask hole row group in the second direction is not more than 2 mm.

5. The method of producing the nozzle plate according to claim 1, wherein the nozzle row group forming step includes the laser irradiation sub-step, and a step for repeating the laser irradiation sub-step, after moving the masking material in the first direction, so as to form a nozzle row group which is longer with respect to the first direction than the nozzle row groups.

6. The method of producing the nozzle plate according to claim 1, wherein the substrate is made of polyimide.

7. The method of producing the nozzle plate according to claim 1, wherein the laser is an excimer laser.

8. The method of producing the nozzle plate according to claim 3, wherein a length of the mask hole row group in the first direction is not more than 20 mm.

9. The method of producing the nozzle plate according to claim 1, wherein the masking material includes a glass substrate made of quartz, and a chromium layer which is formed on a surface of the glass substrate, and the mask holes are formed in the chromium layer.

10. The method of producing the nozzle plate according to claim 1, wherein:

the mask holes in each of the mask hole rows are formed at a predetermined spacing distance in the first direction; and the mask hole rows are arranged to be mutually shifted in the first direction.

11. The method of producing the nozzle plate according to claim 1, wherein two adjacent mask hole rows, among the mask hole rows, are shifted from each other by an amount of ¼ of the predetermined spacing distance.

* * * * *